US007036487B2

(12) United States Patent
Braun et al.

(10) Patent No.: US 7,036,487 B2
(45) Date of Patent: May 2, 2006

(54) FUEL RAIL PULSE DAMPER WITH INTEGRAL STRENGTHENING RIB

(75) Inventors: Charles W. Braun, Livonia, NY (US); Ahmet T. Becene, Henrietta, NY (US)

(73) Assignee: Delphi Technologies, Inc, Troy, MI (US)

( * ) Notice: Subject to any disclaimer, the term of this patent is extended or adjusted under 35 U.S.C. 154(b) by 303 days.

(21) Appl. No.: 10/736,655

(22) Filed: Dec. 16, 2003

(65) Prior Publication Data

US 2005/0126540 A1 Jun. 16, 2005

(51) Int. Cl.
*F02M 55/04* (2006.01)

(52) U.S. Cl. ..... 123/467; 138/26

(58) Field of Classification Search ..... 123/456, 123/467, 468, 469; 138/26–30
See application file for complete search history.

(56) References Cited

U.S. PATENT DOCUMENTS 4,660,524 A * 4/1987 Bertsch et al. ..... 138/30
4,996,961 A * 3/1991 Usui ..... 123/456
6,314,942 B1 * 11/2001 Kilgore et al. ..... 123/467
6,371,083 B1 * 4/2002 Rossi et al. ..... 123/456
6,390,131 B1 * 5/2002 Kilgore ..... 138/30
6,470,859 B1 * 10/2002 Imura et al. ..... 123/467
6,640,783 B1 * 11/2003 Braun et al. ..... 123/467
6,672,286 B1 * 1/2004 Miandoab et al. ..... 123/456
6,725,839 B1 * 4/2004 Zdroik et al. ..... 123/456
6,736,111 B1 * 5/2004 Braun et al. ..... 123/456
6,802,297 B1 * 10/2004 Braun et al. ..... 123/456
6,854,447 B1 * 2/2005 Miandoab et al. ..... 123/467
6,901,914 B1 * 6/2005 Becene et al. ..... 123/456

* cited by examiner

*Primary Examiner*—Thomas Moulis
(74) *Attorney, Agent, or Firm*—Patrick M. Griffin

(57) ABSTRACT

An internal pulse damper for a fuel rail. The damper has an increased captive air volume and consequent improved damping and stress characteristics. The improved damper is a pillow having a modified flat oval cross-sectional profile, with two long diaphragm sides and rigid short sides connecting the two long sides. At least one of the short sides, and preferably both, is strengthened by being provided with a longitudinal reverse bend or inwardly-extending longitudinal rib generally parallel with the long sides. Preferably, the short sides are somewhat higher than the comparable short sides of similar prior art dampers, to increase the captive air volume, yet are not high enough to preclude installation of the improved damper within an existing fuel rail configuration.

10 Claims, 2 Drawing Sheets

FUEL RAIL PULSE DAMPER WITH INTEGRAL STRENGTHENING RIB

TECHNICAL FIELD

The present invention relates to fuel rails for internal combustion engines; more particularly, to devices for damping pulses in fuel being supplied to an engine via a fuel rail; and most particularly, to an improved fuel rail internal damper having increased damping capacity.

BACKGROUND OF THE INVENTION

Fuel rails for supplying fuel to fuel injectors of internal combustion engines are well known. A fuel rail is essentially an elongate fuel manifold connected at an inlet end to a fuel supply system and having a plurality of ports for mating with a plurality of fuel injectors to be supplied.

Fuel rail systems may be recirculating, as is commonly employed in diesel engines wherein fuel sedimentation and injector clogging can be a problem. In gasoline-powered engines, fuel rails are more typically "returnless" or dead ended, wherein all fuel supplied to the fuel rail is dispensed by the fuel injectors.

A well-known problem in fuel rail systems, and especially in returnless systems, is pressure pulsations in the fuel itself. It is known that fuel system damping devices are essential to control fuel system acoustical noise and to improve cylinder-to-cylinder fuel distribution.

Various approaches for damping pulsations in fuel delivery systems are known in the prior art.

For a first example, one or more spring diaphragm devices may be attached to the fuel rail or fuel supply line. These provide only point damping and can lose function at low temperatures. They add hardware cost to an engine, complicate the layout of the fuel rail or fuel line, can allow permeation of fuel vapor, and in many cases simply do not provide adequate damping.

For a second example, the fuel rail itself may be configured to have one or more relatively large, thin, flat sidewalls which can flex in response to sharp pressure fluctuations in the supply system, thus damping pressure excursions by absorption. This configuration can provide excellent damping over a limited range of pressure fluctuations but it is not readily enlarged to meet more stringent requirements for pulse suppression. Further, the thin sidewall of the fuel rail can be exposed to outside impact.

For a third example, a fuel rail may be configured to accept an internal damper comprising a sealed pillow having a flat oval cross-section and formed of various materials including thin stainless steel. Air or an inert gas is trapped within the pillow. The wall material is hermetically sealed and impervious to gasoline. Such devices have relatively large, flat or nearly-flat sides that can flex in response to rapid pressure fluctuations in the fuel system. Internal dampers have excellent damping properties, being easily formed to have diaphragm-like walls on both flat sides, and can be used in rails formed of any material provided the rail is large enough to accommodate the damper within.

The damping characteristics of an internal damper are a function of the thickness of the diaphragm wall, the total wall area, and the volume of captive air. To increase the damping capability of a prior art internal damper requires an increase in the captive air volume, a thinner wall, or increased area of the walls.

Reducing wall thickness is not desirable because it reduces the functional margin between stress and yield.

Increasing the diaphragm wall area is feasible provided that a) the resulting damper is flexible enough to achieve the desired minimum change in volume for a given change in pressure without approaching the material yield point; b) the resulting damper will withstand cyclic fatigue; and c) the resulting damper is still small enough to fit into the fuel rail. Increasing the size of a fuel rail to accommodate a damper having a larger diameter or longer length is highly undesirable because the space adjacent the engine in a vehicle is already highly congested and limited, and because a new fuel rail design or layout increases the cost of manufacturing an engine.

It is a principal object of the present invention to provide an improved internal fuel rail damper having a greater pulse-damping capability.

It is a further object of the invention to provide such a damper requiring minimal or no change in the size of a fuel rail accepting the damper.

It is a still further object of the invention to provide such a damper having excellent structural stability while still providing excellent wall flexure capability.

SUMMARY OF THE INVENTION

Briefly described, an internal pulse damper in accordance with the invention has increased dynamic range and sensitivity. The pulse damper includes a captive air volume substantially greater than that captured by prior art air dampers having the same size diaphragm walls. The improved damper is a pillow having a modified flat oval cross-sectional profile, with two long, flat sides (the diaphragm sides) and short sides connecting the two long sides. To compensate for the greater mass and to enhance overall flexural rigidity of the structure within a fuel rail, the short sides are provided with longitudinal reverse bends, or inwardly-extending longitudinal ribs, extending generally parallel with the long sides. Preferably, the short sides are somewhat higher than the comparable short sides of similar prior art dampers, to increase the captive air volume, yet are not high enough to preclude installation of the improved damper within an existing fuel rail configuration.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 2:
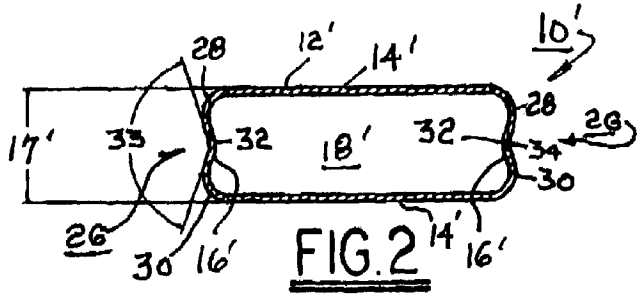
FIG. 2 is a cross-sectional view of a first embodiment of an improved internal pulse damper in accordance with the invention, take along line 2—2 in FIG. 4.
Figure 1:
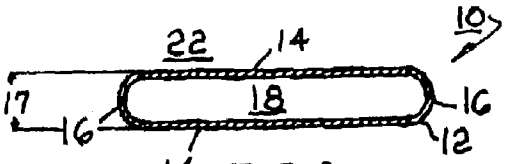
FIG. 1 (PRIOR ART)
FIG. 1 is a cross-sectional view of a prior art internal pulse damper.
Figure 3:
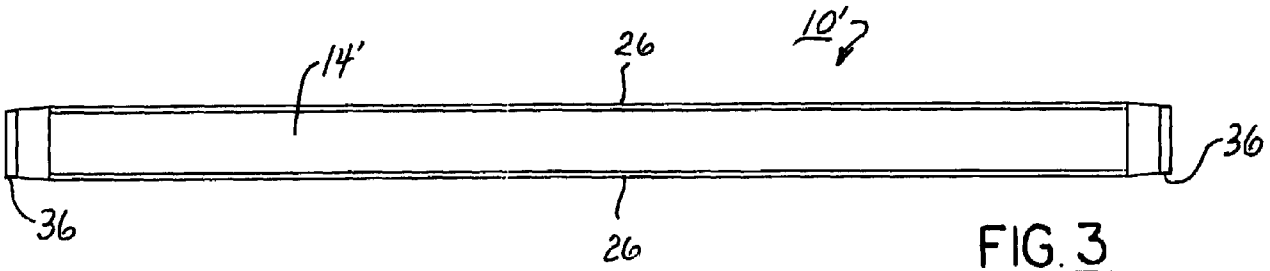
FIG. 3 is a plan view of the damper shown in FIG. 2.
Figure 6:
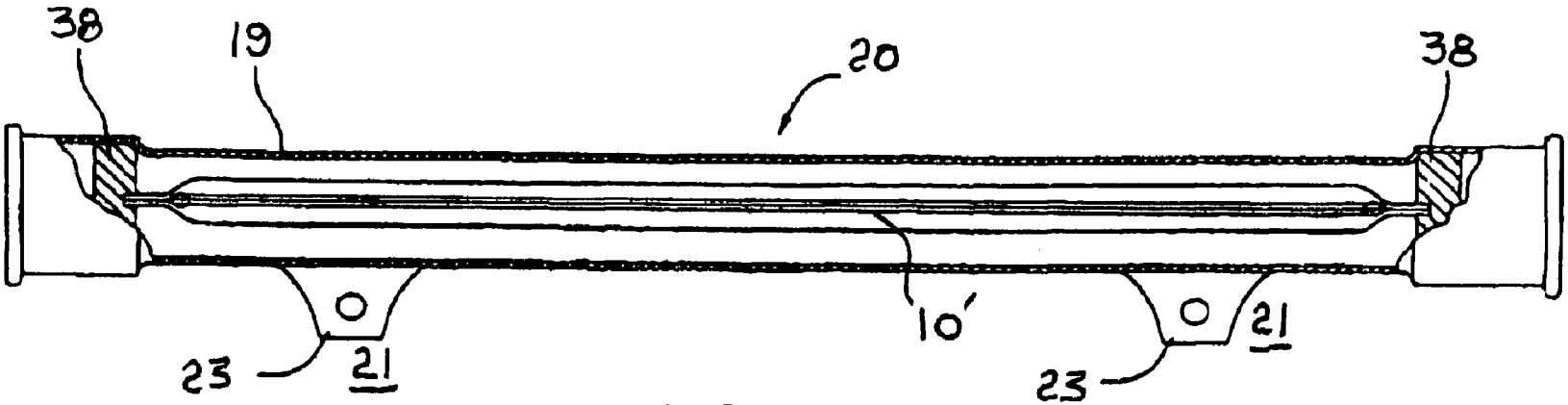
FIG. 6 is a side elevational view of a portion of a fuel rail, partially in cutaway view, showing an improved internal pulse damper disposed within the fuel rail.

Referring to FIG. 1, a prior art internal pulsation damper 10 for inclusion within a fuel rail for an internal combustion engine is formed as an elongate pillow 12, FIG. 1 showing a transverse cross-sectional view thereof. Pillow 12 is formed of thin wall stainless steel having a wall thickness of about 0.012 inches, and is provided with first and second diaphragm sides 14 separated and connected by longitudinal rigid short sides 16 of height 17 (typically about 3.41 mm). The short sides are typically curved as shown such that the cross-sectional shape is referred to in the prior art as a "flat oval." Sides 14 are joined (not shown) at the ends of pillow 12, as by compression of sides 16 (pinching) and welding of sides 14 together, to form a sealed chamber 18 within pillow 12. Chamber 18 is filled with a gas, preferably air. Pillow 12 is disposed within a fuel rail (not shown in FIG. 1 but similarly to improved pillow 12' disposed in a fuel rail 20 as shown in FIG. 6). The aspect ratio of the example shown in pillow 12, that is, the ratio of the typical height of sides 16 (3.41 mm) to the typical width of sides 14 (18 mm), is about 3.41/18=0.19.

In operation, pillow 12 is surrounded by fuel 22 being pumped from a source to fuel injectors (not shown) connected to the fuel rail. Hydraulic pulses being transmitted through fuel 22 are absorbed by inward/outward flexure of diaphragm sides 14 and corresponding compression/expansion of gas in chamber 18. The work done in flexing the sides and compressing the gas consumes the energy of a pulse. The damping characteristics of pillow 12 are limited by the volume of chamber 18.

Referring to FIGS. 2 through 6, an improved internal pulsation damper 10' is formed as a modified flat oval similar to prior art damper 10, the improvement being that rigid short sides 16' are higher 17' than prior art rigid sides 16, preferably about 5.5 mm, thereby increasing the volume of fuel in chamber 18' while the damper responds to a pressure event. Preferably, the length and width of diaphragm sides 14' are about the same as the prior art sides 14 such that improved damper 10' still fits readily into barrel 19 of a prior art fuel rail 20 (FIG. 6) for mounting by means of brackets 23 to an internal combustion engine 21. Preferably, the material forming pillow 12' is an inert metal such as 304 L stainless steel having a wall thickness of about 0.014 inches. Preferably, sides 14' are joined at the ends of pillow 12', as by compression of sides 16' (pinching) and welding of sides 14' together (FIGS. 3, 4, and 5), to form pinched ends 36 and sealed chamber 18' within pillow 12'. Chamber 18' is filled with a gas, preferably air. The aspect ratio of improved pillow 12', that is, the ratio of the preferred height of sides 16' (5.5 mm) to the preferred width of sides 14' (18 mm) is about 5.5/18=0.31.

Figure 4:
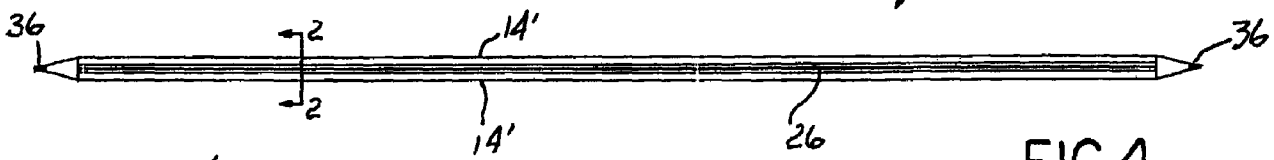
FIG. 4 is a long-side elevational view of the damper shown in FIG. 2.
Figure 5:
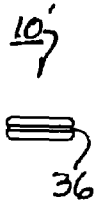
FIG. 5 is a short-side elevational view of the damper shown in FIG. 2.

To increase the flexural rigidity of improved pillow 12', at least one of sides 16', and preferably both (FIG. 2), is provided with an integral reverse bend or strengthening rib 26 running longitudinally of the pillow, as shown in FIG. 4. Rib 26 preferably comprises first and second bends 28,30 that are convex outwards, separated and joined by a third bend 32 that is convex inwards, forming an included angle 33 less than 180° and preferably about 140°. Preferably, a longitudinal seam weld 34 for forming damper 10' is located at the center of bend 32, which removes the seam weld from areas of high cyclic fatigue.

Damper 10' may be suspended and secured in fuel rail 20 without inhibiting the damping capabilities of the damper by capturing the pinched ends 36 of damper 10' in resilient mounts 38 disposed in the fuel rail.

An internal fuel rail damper in accordance with the invention has at least the following advantages over a prior art damper.

First, the overall stress level is lowered, allowing greater damping within a given damper width and material thickness. For example, tests compared improved and prior art dampers of equal length, width, material, and material thickness, at a nominal external pressure of 450 kPa. In the improved damper, the maximum Von Mises stress is reduced from 458 MPa to 379 Mpa. The maximum principal stress is reduced from 485 MPa to 428 MPa.

Second, damping characteristics are improved. In the same comparison, the volume of fuel displaced internally is increased.

Third, the strengthening rib 26 allows the welding seam 34 to be located in the center of a short side 16', thereby removing the welding seam from an area of high cyclic fatigue.

In a similar comparison, using an improved damper having a rib along only one short side 16', stresses are decreased 5% and the volume displaced is increased by 12%.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A pulse damper for inclusion within a fuel rail of an internal combustion engine, comprising:

a) first and second flexible sides; and b) first and second rigid sides connecting and separating said first and second flexible sides to form an elongate pillow having a captive-gas chamber therewithin, at least one of said first and second rigid sides including an integral strengthening rib.

2. A pulse damper in accordance with claim 1 wherein said integral strengthening rib includes first and second bends that are convex outwards and are separated and joined by a third bend that is convex inwards.

3. A pulse damper in accordance with claim 2 wherein said third bend has an included angle of less than 180°.

4. A pulse damper in accordance with claim 3 wherein said included angle is about 140°.

5. A pulse damper in accordance with claim 2 wherein a weld seam is included in said third bend.

6. A pulse damper in accordance with claim 1 wherein an aspect ratio of the height of said rigid sides to the width of said flexible sides is greater than 0.19.

7. A pulse damper in accordance with claim 1 wherein said flexible sides have a thickness of greater than 0.008 inches.

8. A pulse damper in accordance with claim 1 wherein said pillow is formed of stainless steel.

9. A fuel rail for an internal combustion engine, said fuel rail comprising an internal pulse damper, including first and second flexible sides, and first and second rigid sides connecting and separating said first and second flexible sides to form an elongate pillow having a captive-gas chamber therewithin, at least one of said first and second rigid sides including an integral strengthening rib.

10. An internal combustion engine comprising a fuel rail having an internal pulse damper including first and second flexible sides, and first and second rigid sides connecting and separating said first and second flexible sides to form an elongate pillow having a captive-gas chamber therewithin, at least one of said first and second rigid sides including an integral strengthening rib.

* * * * *